United States Patent [19]

Palson

[11] 4,002,232

[45] Jan. 11, 1977

[54] ARTICLE RETAINING POUCH

[75] Inventor: Richard C. J. Palson, Medfield, Mass.

[73] Assignee: International Packaging Corporation, Pawtucket, R.I.

[22] Filed: Apr. 7, 1975

[21] Appl. No.: 565,760

[52] U.S. Cl. ..... 206/5; 85/37

[51] Int. Cl.[2] ..... A45C 11/04; F16B 19/04

[58] Field of Search ..... 206/5 R; 85/37

[56] References Cited

UNITED STATES PATENTS

| | | | |
|---|---|---|---|
| 920,023 | 4/1909 | Chism | 206/5 R |
| 2,758,707 | 8/1956 | Baratelli | 206/5 R |
| 3,367,809 | 2/1968 | Soloff | 85/37 |

*Primary Examiner*—Ro E. Hart
*Assistant Examiner*—Douglas B. Farrow
*Attorney, Agent, or Firm*—Salter & Michaelson

[57] ABSTRACT

A pouch for retaining an article therein including overlying plastic sheets that are secured together to form an interior pocket therebetween, a light-weight, flexible sheet of metal material being captured in the pocket, the plastic sheets and metal sheet captured therebetween being bent along a longitudinal axis approximately at the midpoint thereof so that the opposed longitudinal edges of one of the plastic sheets are located in engaging relation, a rigid end cap being joined to a plastic sheet at an end thereof to define a closed end of the pouch, and the end of the sheets opposite to the end cap being exposed to define an open end for receiving an article in the pouch.

5 Claims, 16 Drawing Figures

ARTICLE RETAINING POUCH

BACKGROUND OF THE INVENTION

The present invention relates to an article retaining pouch, such as an eyeglass case, and to the method of making the pouch.

Pouches for holding an article such as eyeglasses are normally constructed of a relatively rigid leather or plastic material so as to maintain the shape thereof during use for protecting the article contained therein. Although such constructions as made heretofore accomplished the purpose intended, the use of the relatively rigid or heavy gauge leather and/or plastic materials necessarily increased the cost of the article retaining pouch. Prior to the instant invention, some attempts have been made to form such pouches of plastic materials that were reinforced, but such constructions have been found to be impractical and did not resist the usual wear and tear associated with pouches such as eyeglass cases. Further, the use of leather or heavy gauge plastic necessarily increased the cost of the case, and oftentimes such increased costs were prohibitive in the manufacture of the pouch.

SUMMARY OF THE INVENTION

The pouch as embodied in the subject invention has particular application as an eyeglass case; although, the construction of the pouch is adaptable for being used for various other article retaining cases.

In order to provide a relatively rigid construction for the case embodied in the subject invention, and to protect the article contained therein, a sheet of light-weight metal material is captured between a pair of plastic sheets, the plastic sheets being laminated to form an interior pocket in which the metal sheet is located. The metal sheet is bendable along the longitudinal axis thereof; and in order to form an open-ended pouch, the plastic sheets, together with the metal sheet, are folded approximately at the midpoint along the longitudinal axes thereof until the opposed longitudinal edges of the plastic sheets are located in engaging relation. One end of the folded laminated plastic sheets and metal sheet is closed by securing a rigid end cap assembly to end portions of one of the plastic sheets, the end cap assembly comprising a pair of preformed plastic end cap portions that are constructed for receiving the end portions of one of the plastic sheets therebetween in secure relation. In one form of the invention the longitudinal opposed edges of one of the plastic sheets is then secured together by stitching to complete the case construction, the end of the case or pouch opposite to the fixed plate assembly being exposed for receiving an article therein. In a modified form of the invention the longitudinal edges of the plastic sheet are secured together by heat sealing.

Accordingly, it is an object of the present invention to provide a pouch for retaining an article therein that is comprised of overlying sheets of plastic material between which a light-weight, flexible sheet of metal material is captured, the plastic and metal sheets being bent approximately at the midpoint thereof and being secured along the opposed longitudinal edges of a plastic sheet to define the pouch.

Another object of the invention is to provide a method of manufacturing an article retaining pouch that includes the steps of securing a light-weight, flexible metal material between sheets of plastic material, the metal material and sheets of plastic being bent along the longitudinal axes thereof to define the pouch construction as required.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 6:
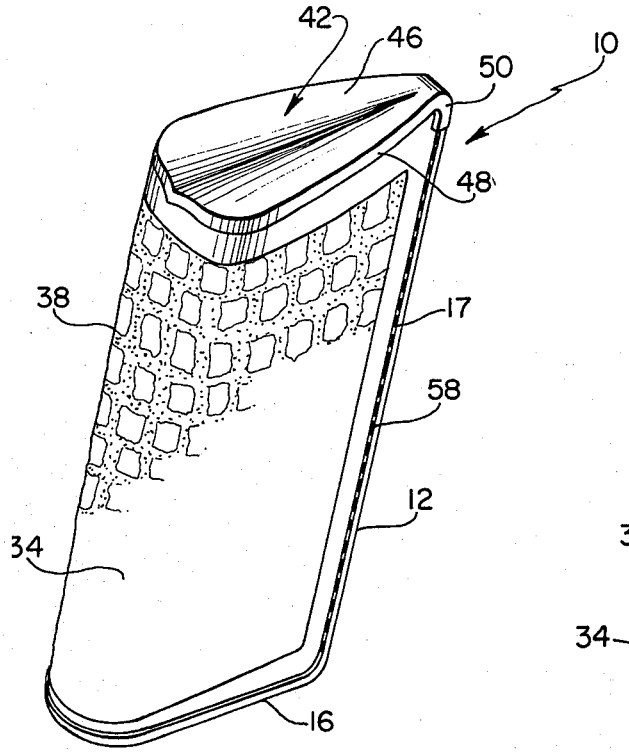
FIG. 6 is a perspective view of the finished pouch showing the location of the end cap assembly as secured to an end of the pouch.
Figure 7:
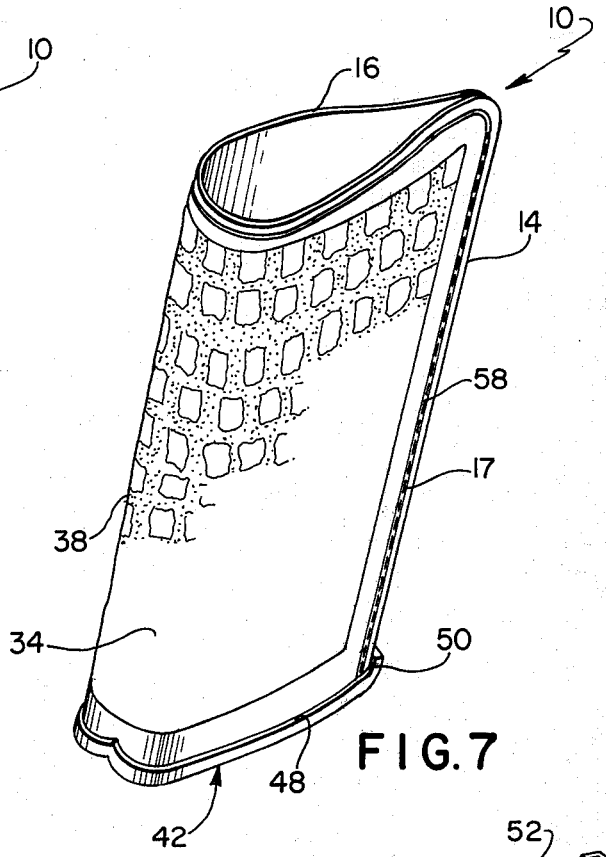
FIG. 7 is a perspective view of the finished pouch shown in reverse position, relative to FIG. 6, and illustrating the open end of the pouch.

Referring now to the drawings, the pouch as embodied in the present invention is indicated generally at 10 in FIGS. 6 and 7, and as shown therein the pouch 10 is designed for use as an eyeglass case. However, it is understood that the pouch 10 may be constructed and arranged in accordance with the present invention to define a case for receiving a variety of articles therein.

Figure 1:
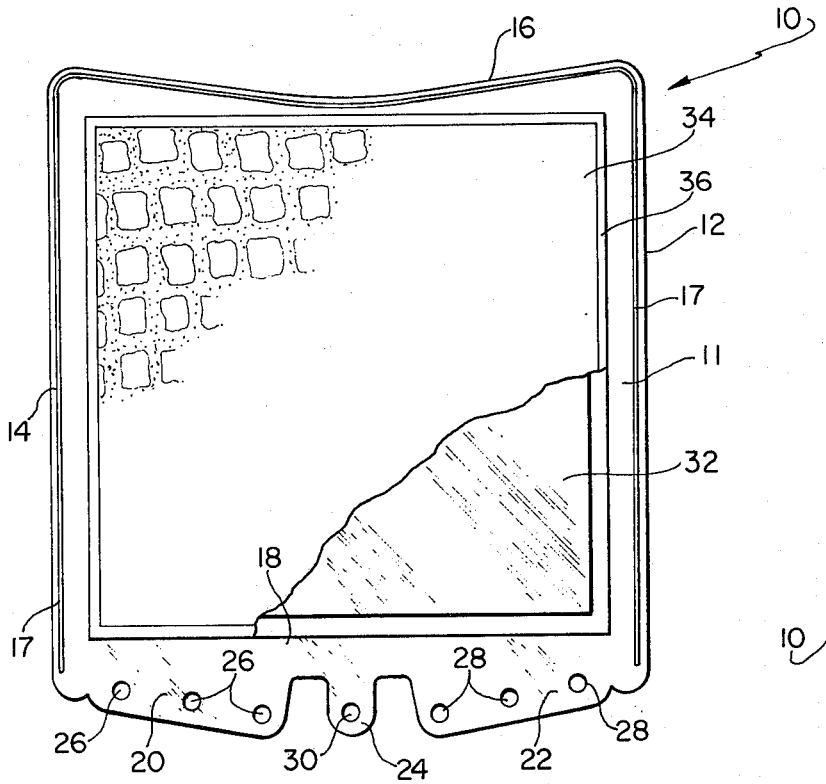
FIG. 1 is a top plan view with portions broken away of the overlying plastic sheets with the metal material captured therebetween prior to the bending thereof in the formation of the pouch.

Referring to FIGS. 1–5, the method of forming the pouch 10 is illustrated; and as shown in FIG. 1, a first plastic sheet 11 is provided that is defined by opposed longitudinal edges 12 and 14, a curved end 16, and an opposite end 18 on which projecting portions 20 and 22 and a tab 24 are formed, the tab 24 being located intermediate the projecting portions 20 and 22. For the purpose to be described hereinafter, the projecting portion 20 is formed with holes 26 therein, while the projecting portion 22 is formed with similar holes 28 therein. The tab 24 is also formed with a hole 30.

The sheet 11 is formed of a suitable plastic material, such as polystyrene, the outside surface being smooth, but the inside surface thereof having the feel and appearance of a flocking that provides a protective surface for an article that is received in the interior of the pouch 10. The peripheral edges 12, 14 and 16 have an impression 17 formed therein that is heat set and that imparts a finished appearance to the sheet 11.

Figure 2:
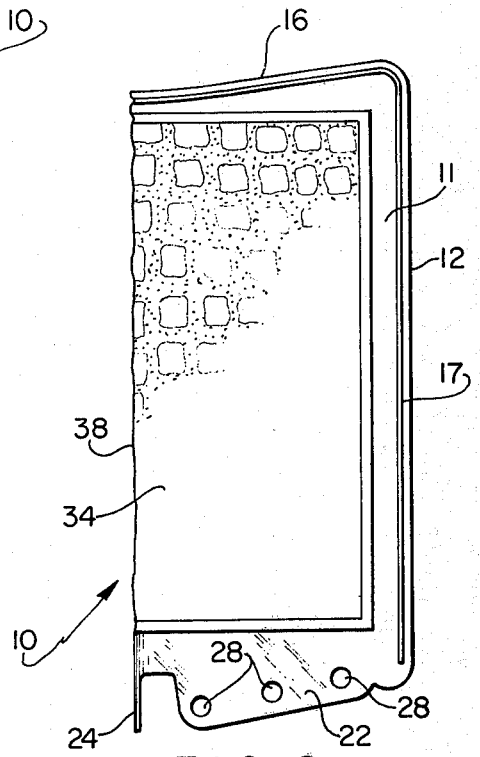
FIG. 2 is an elevational view of the plastic sheets and metal sheet captured therebetween after the bending along the longitudinal axes thereof during formation of the pouch.

Since the plastic sheet 11 is formed of a relatively flexible material, it is necessary to provide rigidity therefor when it is bent to the required pouch configuration; and as shown in FIG. 2, a relatively light-weight, thin-gauge metal sheet 32 is provided and is located approximately centrally of the plastic sheet 11 in overlying relation therewith. The metal sheet 32 which is dimensioned to be located within the borders of the plastic sheet 11 is captured in place thereon by forming a pocket between the plastic sheet 11 and an overlay second plastic sheet 34. As shown more clearly in FIG. 1, the second plastic sheet 34 has a dimension that is slightly larger than that of the metal sheet 32 but less than that of sheet 11, and is heat sealed to the plastic sheet 11 along a seam 36 that extends around the periphery of the plastic sheet 34. A pocket is thus defined between the plastic sheet 34 and the plastic sheet 11 in which the metal sheet 32 is confined. If desired, the outermost surface of the plastic sheet 34 may be decorated in a manner to simulate a leather material, such as alligator or the like.

Figure 3:
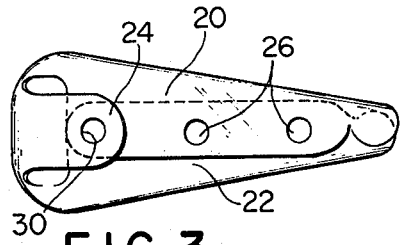
FIG. 3 is an end elevational view of the plastic sheets after the bending thereof and showing the location of the projecting portions of the plastic sheets prior to the assembly thereof with the fixed end plate assembly.
Figure 4:
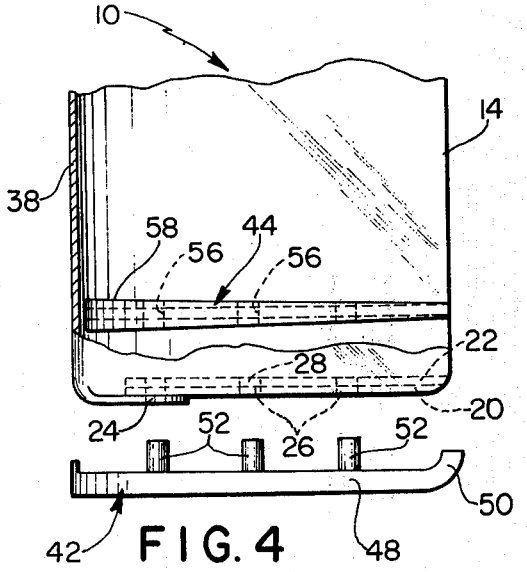
FIG. 4 is an exploded view with portions shown in section of the end of the pouch showing the plates of the plate assembly prior to the assembly thereof with the projecting portions of one of the plastic sheets captured therebetween.

With the metal sheet 32 captured between the plastic sheets 11 and 34 that are heat sealed together along the marginal edge 36 of the sheet 34, the assembly as illustrated in FIG. 1 is bent approximately at the midpoint thereof and along the longitudinal axis indicated at 38 in FIG. 2. With the assembly bent in the manner as illustrated in FIG. 2, the opposed longitudinal edges 12 and 14 of the sheet 11 are located in engaging relation and, as will be described hereinafter, are secured together in a convenient manner. The curved edge 16 of the plastic sheet 10 defines an open end of the pouch 10 through which an article is to be inserted, as will be described. The end opposite to the open end of the pouch 10 is closed to define the bottom of the pouch; and for this purpose, the end portions 20 and 22 and the tab 24 of the sheet 11 are folded in overlapping relation as illustrated in FIG. 3, so that the holes 26 and 28 are disposed in corresponding aligned relation; and the hole 30 is aligned with corresponding holes 26 and 28 as further illustrated in FIG. 3.

Figure 8:
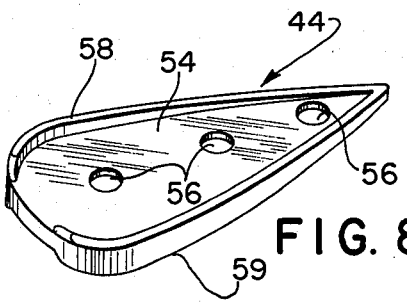
FIG. 8 is a perspective view of one of the plates of the end cap assembly.
Figure 9:
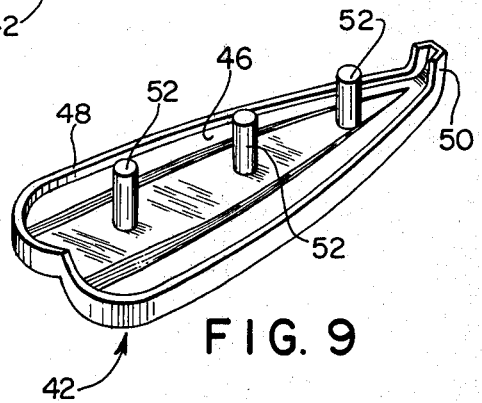
FIG. 9 is a perspective view showing the other plate of the end cap assembly.
Figure 10:
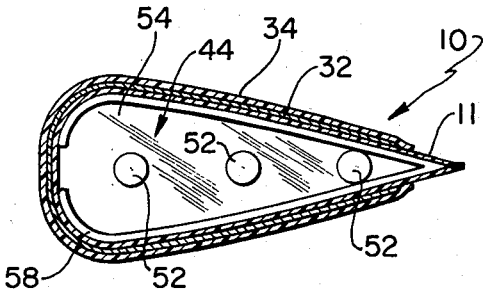
FIG. 10 is a sectional view taken along line 10—10 in FIG. 5.

In order to seal the projecting portions 20 and 22 and the tab 24 in overlapping relation to define the bottom of the pouch 10, a plate assembly is provided and includes an outer plate generally indicated at 42 in FIG. 9 and an inner plate generally indicated at 44 in FIG. 8. The outer plate 42 is formed in a modified triangular configuration and includes a base 46 around which a marginal flange 48 extends. The smaller end of the outer plate 42 includes a projection 50 that is formed as an extension of the marginal flange 48, and joined to the base 46 and extending upwardly therefrom are a plurality of spaced pins 52 that are dimensioned to be received in the holes 26, 28 and 30 of the end portions 20, 22 and tab 24, respectively. The inner plate 44 is also formed with a base 54 in which openings 56 are formed that are also dimensioned for receiving the pins 52 therein. Joined as an integral part of the base 54 and extending outwardly therefrom are oppositely located peripheral lips 58 and 59. The configuration of the inner plate 44 is also that of a modified triangle and conforms to the configuration of the outer plate 42, the dimension of the inner plate 44 being slightly less than that of the outer plate 42, wherein the inner plate 44 is received within the peripheral flange 48 in the assembly of the plates.

Figure 5:
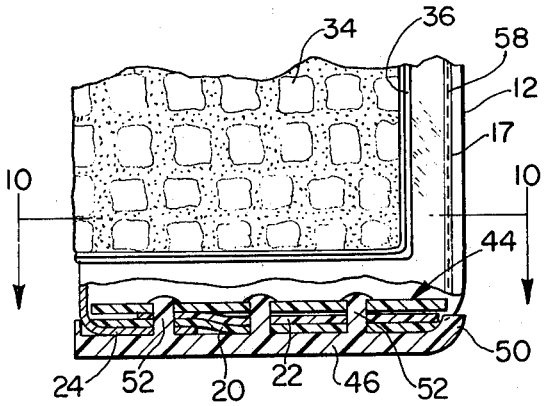
FIG. 5 is a fragmentary side elevational view of the assembled pouch with portions shown in section and illustrating the manner in which the plate assembly is secured to the projecting end portions of one of the plastic sheets.

The plates 42 and 44 are secured in place by locating the plate 42 exteriorly of the projecting portions 20, 22 and the tab 24, the openings 26, 28 and 30 receiving the pins 52 therethrough as illustrated in FIG. 5. The inner plate 44 is then positioned in overlying relation relative to the projecting portions 20, 22 and tab 24, the pins 52 further extending through the openings 56 in the base 54 of the plate 44. The shape and configuration of the outer and inner plates 42 and 44 conform to the general shape and configuration of the folded end portions 20, 22 and the tab 24 and with the end portions and tab captured between the plates 42 and 44, the ends of the pins 52 are deformed as illustrated in FIG. 5 to lock the plate 44 to the plate 42. The end of the pouch 10 opposite to the open end thereof is then sealed and closed as illustrated in FIG. 6. The longitudinal edges 12 and 14 of the sheet 11 that are located in engaging relation after the bending thereof to the position illustrated in FIG. 2 are then secured together by any convenient technique; but as indicated in FIGS. 6 and 7, stitching 60 is utilized to secure the longitudinal edges 12 and 14 together.

It is seen that the pouch 40 is completely assembled without the requirement of any glue or adhesive, which is normally used in eyeglass containers and which oftentimes causes the sealed edges of such containers to separate. After the plastic sheets 11 and 34 are sealed together with the metal sheet 32 captured therebetween, it is a relatively simple matter to bend the assembled sheets along the longitudinal axes thereof and approximately at the midpoint to locate the sheets in position for assembly with the plates 42 and 44. The plates 42 and 44 are secured to the end portions 20 and 22 and tab 24 of the plastic sheet 11 in a relatively simple operation, and with the heads of the pins 52 being deformed as illustrated in FIG. 5, the assembly of the case is completed upon application of the stitching 58 to the longitudinal edges 12 and 14 of the sheet 11.

It is seen that the pouch 10 as constructed in accordance with the present invention is simple in construction and is assembled in a relatively few manufacturing steps. The pouch 10 is also rugged and resistant to wear and tear; and because of the flexible metal plate 32 that forms a part of the walls of the pouch 10, fragile articles, such as eyeglasses, are properly protected when inserted into the interior of the pouch. The materials from which the pouch is constructed other than the metal plate 34 are formed essentially of plastic and are relatively inexpensive when compared to other materials such as leather. Thus, the total cost of the manufacture of the pouch represents a considerable saving over the prior known leather pouches employed heretofore.

Figure 11:
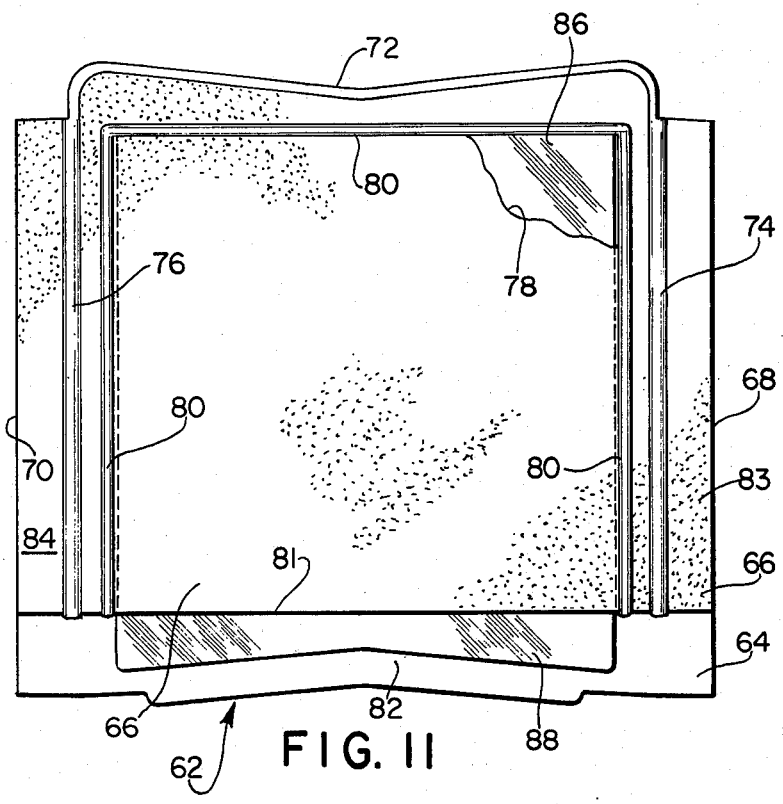
FIG. 11 is a top plan view with portions broken away of a modified form of the invention showing the overlying plastic sheets and the metal plate captured therebetween prior to the bending thereof to the pouch configuration.
Figure 12:
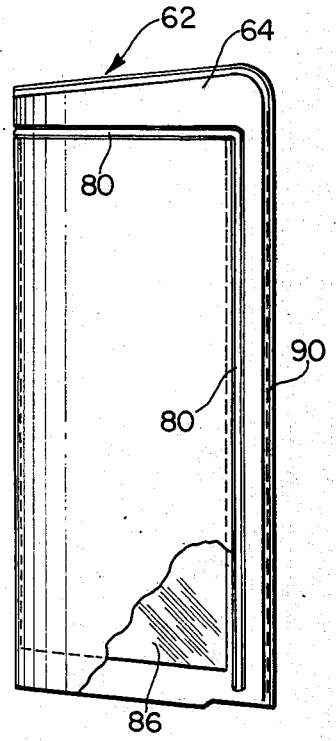
FIG. 12 is a side elevational view with portions broken away of the finished pouch of the modified form of the invention.
Figure 13:
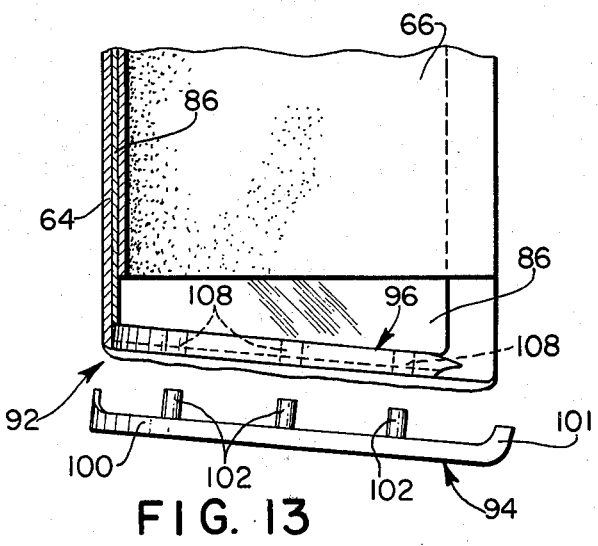
FIG. 13 is an exploded view with portions broken away and shown in section showing the plates of the end cap assembly of the modification prior to the assembly thereof with the end portions of a plastic sheet.

Referring now to FIGS. 11–16, a modified form of the invention is illustrated, however the basic concept of forming a pouch is incorporated therein. As illustrated in FIG. 12, a pouch generally indicated at 62 is illustrated and is formed in a manner that is substantially like the pouch 10 described above.

Referring to FIG. 11, the pouch 10 includes a first plastic sheet 64, the outer surface of which simulates a leather material. A second inner sheet 66 of plastic material overlies the first plastic sheet 64 and has a flocking type of surface on the exposed side thereof, which surface defines the inside of the pouch 62, as will be described.

The first and second plastic sheets are die cut and heat sealed in a single operation to secure the sheets along three of their marginal edges as indicated at 68, 70 and 72, additional seal lines 74 and 76 being added along the sides of the sheets, which eventually form a sealed edge as will also be described. When the sheets 64 and 66 are sealed along their edge, an interior pocket 78 is formed by also sealing the sheets with a continuous seal line 80 that extends along three sides of the sheets. The exposed side of the pocket is defined by an unsealed edge 81 of the sheets 66 and as shown in FIG. 11, the sheet 66 is foreshortened with respect to the sheet 64 at the unsealed side thereof to define an exposed end portion 82 of the sheet 64 and an opening for the pocket 78. It is also seen in FIG. 11, that when the sheets 64 and 66 are die cut and heat sealed, side flaps 83 and 84 are formed on the outer edges of which the sealed edges 68 and 70 are located. The sealed edge 72 is also shaped in a modified V-configuration to provide for the formation of the mouth of the pouch 10 in the finished construction. Similarly, the opposite end of the sheet 64 is formed in a configuration that facilitates assembly thereof to an end cap as will be described hereinafter.

The foreshortening of the sheet 66 with respect to the sheet 64 along the unsealed edge 81 of the sheet 66 provides a convenient opening for the pocket 78 through which a relatively thin, flexible metal sheet 86 is inserted. The metal sheet 86 in the fully inserted position in the pocket 78 has a portion 88 thereof extending outwardly of the edge 82 of the sheet 66 that overlies the exposed portion 82 of the sheet 64.

Figure 16:
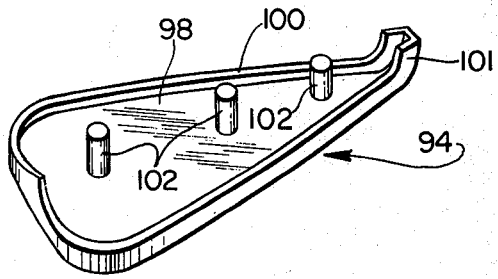
FIG. 16 is a perspective view showing the other end cap portion of the modified form of the invention.

In order to form the pouch 10 in the finished construction thereof, the assembly as illustrated in FIG. 11 is folded along the longitudinally extending median line thereof until the edges 68 and 70 of the flaps 83 and 84 coincide. The second sheet 68 with the flocking type of exposed surface thus defines the inside of the pouch. The edges 68 and 70 are then heat sealed to define an edge 90 (FIG. 12) and the excess material is removed therefrom. An end cap 92 defined by an outer cap portion generally indicated at 94 and inner cap portion generally indicated at 96 is next attached to the open side of the pouch as formed by the folded exposed end portion 82 of the plastic sheet 64. As illustrated in FIG. 16, the outer cap portion 94 is defined by a generally triangularly shaped base 98 around which a peripheral edge 100 extends, the peripheral edge forming a projecting portion 101 at the apex of the triangular base. Joined to the base and extending along the mid line thereof in spaced relation are a plurality of pins 102. The inner cap portion 96 has a base 104 formed in a triangular-like configuration corresponding to that of the outer cap portion 94 and extending around the periphery of the base 104 is an upstanding peripheral edge 106. Formed in the base 104 are spaced openings 108 which receive the pins 102 therein when the end cap is assembled.

Figure 14:
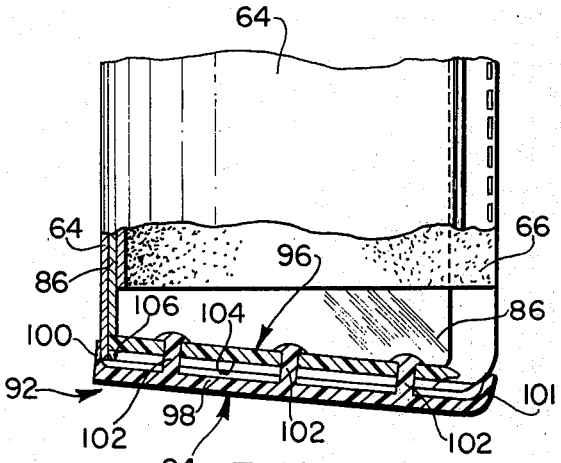
FIG. 14 is a fragmentary side elevational view with portions shown in section of the finished pouch construction illustrated in FIG. 12.
Figure 15:
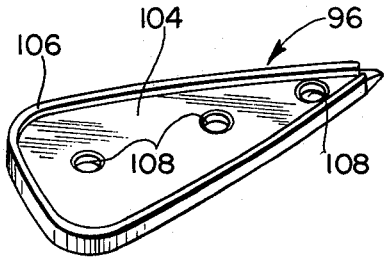
FIG. 15 is a perspective view showing one of the end cap portions of the modified form of the invention.

The end cap 92 is assembled in place to complete the pouch construction by capturing the edge 82 of the sheet 64 between the cap portions 94 and 96, the cap portions being secured together by upsetting by heat, the ends of the pins 102 that are received in the openings 108 of the cap portion 96 (FIG. 14). As further shown in FIG. 14, the peripheral edge 106 of the cap portion 96 extends downwardly and is received within the upwardly facing peripheral edge 100 of the cap portion 94. The peripheral edges 100 and 106 thus cooperate to lock the marginal portion of the edge 82 of the plastic sheet 64 therebetween.

The pouch 62 as formed avoids the stitching 60 as provided for in the construction illustrated in FIG. 7, the sealed edge 90 preferably being formed with a simulated stitching imprinted therein by the heat sealing device.

The modified form of the invention also avoids the formation of the projecting portions on the first plastic sheet in which the holes are formed for receiving the pins 52, the interfitting cooperation of the cap portions being sufficient to lock the end cap 92 to the free end 82 of the plastic sheet 64. However, in both forms of the invention as illustrated and described herein, the plastic sheets define a pocket for receiving the flexible metal sheet therein that provides the necessary stiffness for protecting the eyeglasses located in the pouch. In both forms of the invention the assembly of the pouch is relatively simple, and a pouch of superior construction and appearance is defined, the cost of which is relatively low in comparison to known pouches of comparable quality.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A pouch for retaining an article therein, comprising a first sheet of plastic material, a second sheet of plastic material secured to said first sheet along a seal line to form an interior pocket between said sheets, a light-weight, flexible sheet of metal material captured in said pocket and conforming generally to the configuration of said sheets, said plastic sheets and metal sheet captured therebetween being bent along a longitudinal axis approximately at the midpoint thereof, wherein the opposed longitudinal edges of said first sheet are secured together to define a longitudinal side edge of said pouch, and a rigid end cap joined to said first sheet at an end thereof to define a closed end of said pouch, an end of said first plastic sheet extending beyond said second plastic sheet and metal sheet as disposed in said pocket and defining end portions, said end cap including a pair of cap portions, one of said cap portions having a plurality of projections formed thereon, the other cap portion having a plurality of openings formed therein that receive said projections in a locking position of said cap portions, said end portions being received between said cap portions for the securement thereof in the locking position to seal the closed end of said pouch, the end of said plastic sheets opposite to said end cap being exposed to define an open end for receiving the article in the pouch.

2. A pouch as claimed in claim 1, the longitudinal edges of said first sheet being secured together by heat sealing to close the pouch along the length thereof.

3. A pouch as claimed in claim 2, the longitudinal edges of said first sheet being secured together by stitching to close the pouch along the length thereof.

4. A pouch as claimed in claim 1, said second sheet overlying substantially the entire portion of said first sheet, except along the edge thereof that is attached to said end cap wherein said second sheet is foreshortened with respect to said first sheet, a portion of the foreshortened edge of said second sheet being unsecured to said first sheet to define an opening therewith to said pocket and through which said metal sheet is inserted.

5. A pouch for retaining an article therein, comprising a first sheet of plastic material, a second sheet of plastic material secured to said first sheet along a seal line to form an interior pocket between said sheets, a light-weight, flexible sheet of metal material captured in said pocket and conforming generally to the configuration of said plastic sheets, said plastic sheets and metal sheet as captured therebetween being bent along a longitudinal axis approximately at the midpoint thereof, wherein the opposed longitudinal edges of said first sheet are secured together to define a longitudinal side edge of said pouch, and a rigid end cap joined to said first sheet at an end thereof to define a closed end of said pouch, an end of said first plastic sheet extending beyond said second plastic sheet and metal sheet as disposed in said pocket and defining end portions that foldably engage said end cap, said end cap including a pair of cap portions that are locked together and between which said end portions are secured, the end portions having holes formed therein, one of said cap portions having a plurality of projections formed thereon, the other cap portion having a plurality of openings formed therein that receive said projections therein in the locked position of said cap portions, the holes in said end portions of said first plastic sheet receiving said projections therein for securing said end portions between said cap portions in the locked position thereof, the end of said sheets opposite to said end cap being exposed to define an open end for receiving the article in the pouch.

* * * * *